US007506465B2

(12) United States Patent
Hansen, Jr.

(10) Patent No.: US 7,506,465 B2
(45) Date of Patent: Mar. 24, 2009

(54) ADVERTISING SIGN AND METHOD OF MAKING SAME

(75) Inventor: David J. Hansen, Jr., Geneva, IL (US)

(73) Assignee: ImageForward, Inc., Geneva, IL (US)

( * ) Notice: Subject to any disclaimer, the term of this patent is extended or adjusted under 35 U.S.C. 154(b) by 0 days.

(21) Appl. No.: 10/831,278

(22) Filed: Apr. 23, 2004

(65) Prior Publication Data

US 2005/0235538 A1 Oct. 27, 2005

(51) Int. Cl.
*G09F 15/00* (2006.01)

(52) U.S. Cl. ..... 40/606.01; 40/606.18

(58) Field of Classification Search ..... 40/611.01, 40/611.06, 606.18, 610, 603, 465, 775–776, 40/654.01, 606.01, 606.09; 150/154; 206/320, 206/305; 340/305, 541, 546, 555, 556, 571, 340/573, 527.1–527.9; 312/283–290
See application file for complete search history.

(56) References Cited

U.S. PATENT DOCUMENTS

| | | | | | |
|---|---|---|---|---|---|
| 2,127,930 | A | | 8/1938 | Osborn | |
| 2,333,302 | A | * | 11/1943 | Enk | 40/643 |
| 2,677,910 | A | * | 5/1954 | Morgan | 40/711 |
| 2,798,317 | A | | 7/1957 | Hargus | |
| 2,914,874 | A | | 12/1959 | Stein | |
| 4,516,620 | A | * | 5/1985 | Mulhern | 160/351 |
| 4,660,310 | A | * | 4/1987 | Farmer | 40/607.03 |
| 4,771,560 | A | | 9/1988 | Richards | |
| 5,030,941 | A | * | 7/1991 | Lizzi et al. | 340/541 |
| 5,212,898 | A | * | 5/1993 | Dinan et al. | 40/607.12 |
| 5,452,965 | A | * | 9/1995 | Hughes, Sr. | 404/10 |
| 5,595,010 | A | | 1/1997 | Fuller | |

(Continued)

OTHER PUBLICATIONS htt://web.archive.org/web/20031229223822/www.faberpro-motion.nl/index.php?PagID=534.*

*Primary Examiner*—Cassandra Davis
(74) *Attorney, Agent, or Firm*—Law Office of John W. Harbst

(57) ABSTRACT

An advertising sign configured for use in combination with an upstanding security system having a detection apparatus. The advertising sign comprises a substrate with a generally rectangularly shaped outer edge configuration having first and second generally parallel and planar surfaces, with a multicolor advertising copy printed across substantially the entirety of at least one of the planar surfaces with solvent inks thereby yielding protection to the substrate against exposure to atmospheric elements and thereby prolonging the life of the sign during use. The substrate also defines an opening spaced a predetermined distance from at least two edges of the printed substrate to facilitate alignment of the opening relative to the detection apparatus of the security system whereby allowing passage of a signal from the detection apparatus of the security system to pass through the substrate. Two opposed edges of the substrate are operably secured together to form an elongated sleeve-like advertisement with a pair of axially aligned open ends. Such advertising sleeve is sized to fit along and about marginal edges of the upstanding security system and with the opening in the substrate facilitating proper alignment of a predetermined pattern printed on the substrate relative to the upstanding security system such that said imprinted substrate arranged about said security system defines an upstanding point-of purchase advertising medium. A method of making an advertising sign for use with a security system is also provided.

27 Claims, 6 Drawing Sheets
(3 of 6 Drawing Sheet(s) Filed in Color)

U.S. PATENT DOCUMENTS 5,860,237 A * 1/1999 Johnson ..... 40/603
5,966,857 A 10/1999 Pettersson et al.
6,164,005 A 12/2000 Copeland
6,308,447 B1 10/2001 Tress
6,789,340 B2 * 9/2004 Chasnoff ..... 40/661
2001/0042328 A1 * 11/2001 Matteau et al. ..... 40/537
2002/0116854 A1 * 8/2002 Rappaport et al. ..... 40/776
2002/0175096 A1 * 11/2002 Linihan ..... 206/305
2005/0166431 A1 * 8/2005 Boron et al. ..... 40/607.03

* cited by examiner

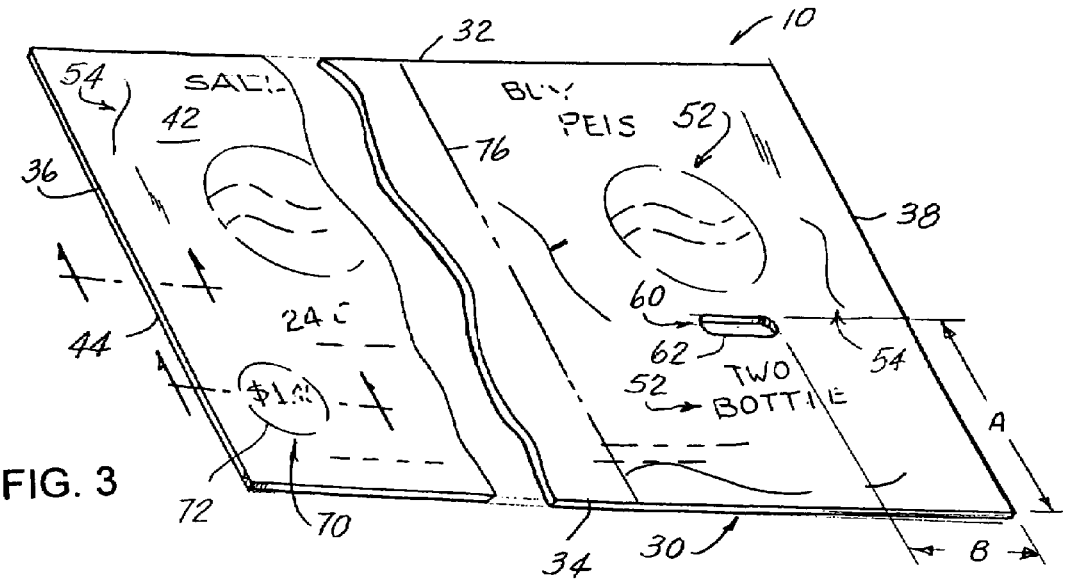
FIG. 3
FIG. 4
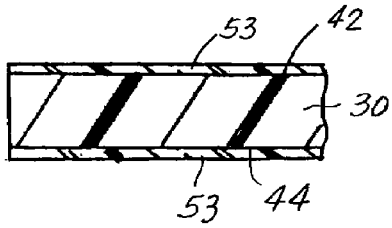
FIG. 5
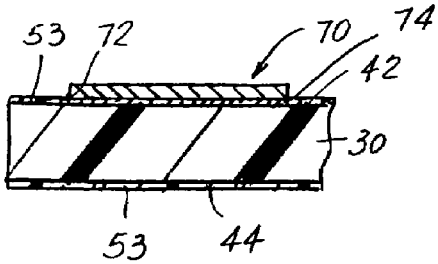
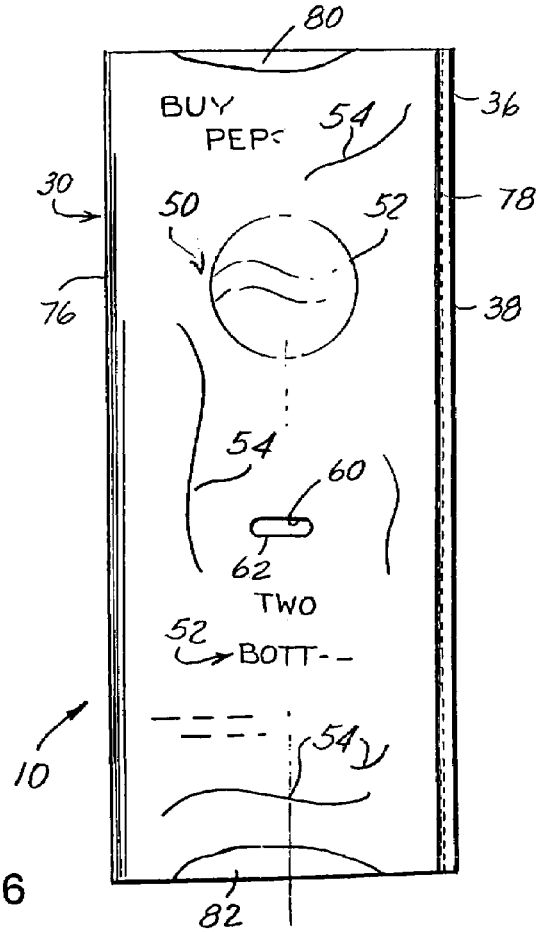
FIG. 6

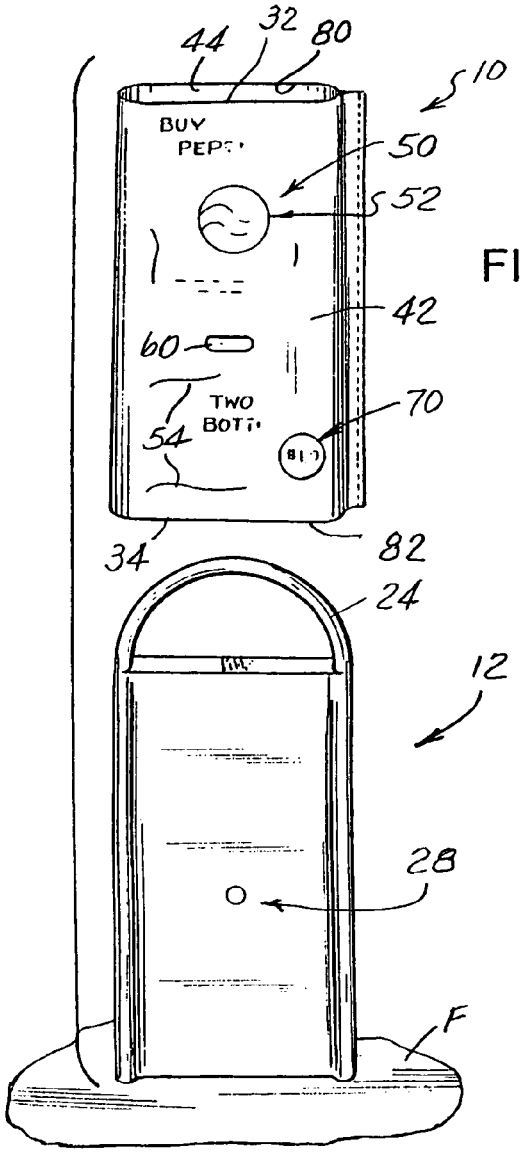
FIG. 7
FIG. 8
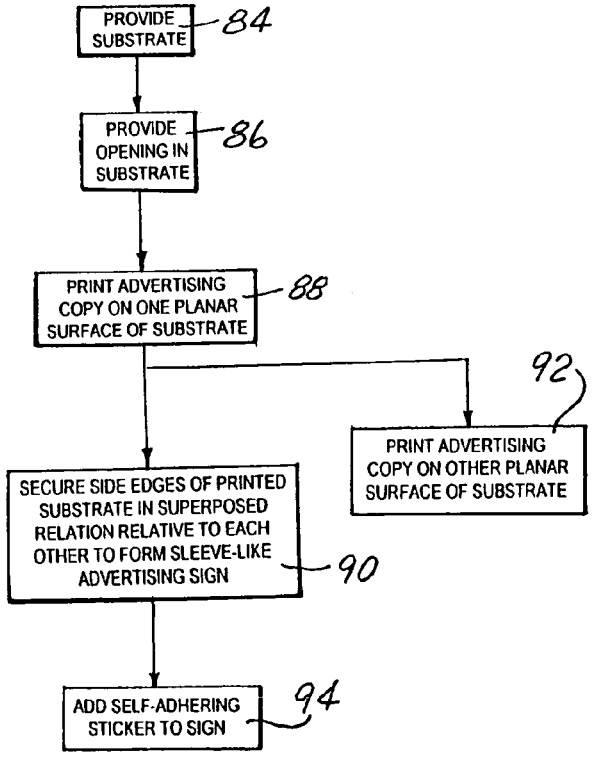

ADVERTISING SIGN AND METHOD OF MAKING SAME

FIELD OF THE INVENTION

The present invention generally relates to the field of display signs and, more particularly, to a display sign which converts existing space utilized by a self-supported security apparatus into a point of entry advertising system.

BACKGROUND OF THE INVENTION

Advertising signs are used throughout any number of various stores. Such advertising signs attract attention and inform customer's as to the availability of certain products/services in the store and, in many instances, to current sale prices for particular products/services. Signs are also used to direct customer's attention to the location of various products in the store.

The location of such in-store advertising is of paramount importance in initially grasping and attracting customer's attention to the advertised products/services offered in a particular store. Accordingly, advertisers continually strive to optimize the location of their advertising within the store. Moreover, advertisers are often prepared to spend and do, in fact, spend considerable extra money simply to improve the location of their advertising within a store. As with real estate, "location, location, location" is the number one rule in advertising. In this regard, the best possible advertising location in a store is at store level and proximate to the entry and egress location to the store. By locating an advertising sign in proximity to the entry door to the store, everyone entering and leaving the store must pass products/services being advertised.

Although having many advantages, arranging an adverting sign at store level proximate to the entry and exit door to a store is fraught with challenges and significant problems. First, arranging an advertising sign at store level and proximate to an entrance to the store naturally exposes the sign to atmospheric conditions, such as rain, snow, sleet, the damaging effects of sun exposure, and wind. As such, and when the sign extends to the floor, some signs tend to absorb and wick moisture on the floor. Such absorption and "wicking" of moisture can quickly deteriorate and, ultimately, ruin a sign. Second, arranging a sign at store level and proximate to the store entrance requires the sign to be secured in place or to have sufficient weight to prevent the sign from shifting and/or moving as a result of wind gusts blowing through the store entrance. As will be appreciated, securing the advertising sign to the floor and/or adding weight to the sign also adds to the overall costs of the sign. Of course, if the advertising signs inadvertently moves in response to wind gusts and the like blowing through the entrance, such signs can present a problem of hindering access to the store. Access to and through the entryway to a store is an especially important concern when considering handicap access to the store.

The problems associated with providing advertising in proximate relation to the store entry/exit location is exacerbated by the presence of entrance/exit security systems necessarily arranged in proximate relation to the entrance to almost every store. Given the choice between advertising and security against theft and the like, almost every store has opted for security. As is known, and albeit aesthetically unsightly, such security systems typically include a pair of five to six foot high security columns or towers arranged immediately adjacent and on opposed inner sides of a store entrance. Typically, security systems include a detection apparatus which, in one form, utilizes an infrared beam or other suitable signal, directed between and from one security tower to the other. Store owners prefer to remove the advertising from being arranged even in proximity to such security towers in view of concerns that such signs could be inadvertently moved as a result of wing gusts, inadvertent kicking or otherwise, thereby resulting in such signs blocking the signal directed between such security towers.

Thus, there is a continuing need and desire for an advertising sign which can be located adjacent to the store entrance whereby maximizing exposure of the product/services advertised while alleviating concerns over weather related deterioration, access to and through the entryway, and which serve in conjunction with existing security devices disposed proximate to the doorway.

SUMMARY OF THE INVENTION

In view of the above, and in accordance with one aspect, there is provided an advertising sign configured for use in combination with an upstanding security system having a detection apparatus. The advertising sign comprises a substrate having four edges for providing the substrate with a generally rectangularly shaped outer edge configuration. The substrate further has first and second generally parallel and planar major surfaces, with a multicolor advertising copy being printed in a predetermined pattern across all or substantially the entirety of at least one of the planar surfaces with solvent inks thereby yielding protection to the sign against exposure to atmospheric elements and, thus, prolonging the usefulness of the sign. The substrate defines an opening spaced a predetermined distance from at least two edges of the printed substrate. The opening in the substrate permits the detection apparatus signal of the security system to pass through the substrate. Two opposed edges of the substrate are operably secured together to form an elongated sleeve-like advertisement with a pair of axially aligned open ends. Such advertising sleeve is sized to fit along and about marginal edges of the upstanding security system and with the opening in the substrate facilitating proper alignment of the predetermined pattern on the multicolor advertisement on the sign relative to the upstanding security system such that the imprinted substrate arranged about the security system defines an upstanding point-of purchase advertising medium.

In a preferred form, the substrate has a thickness between the planar surfaces ranging between about 10 mils to about 14 mils. Preferably, the advertising sign further includes a sticker adhesively secured to a predetermined area on the printed surface of the sign for effecting changes in the sign. In a most preferred form, the edges of the substrate are operably secured to each other by a line of stitching.

To enhance the versatility of the advertising sign, another multicolor advertisement can be printed in a predetermined pattern across all or substantially the entirety of the other of the two planar surfaces on the substrate preferably using solvent inks. Preferably, the substrate is formed from a synthetic material selected from a class of materials including: plastic and vinyl.

According to another aspect there is provided an advertising sign configured for use with an upstanding security system having a detection apparatus arranged between top and bottom portions of the security. The advertising sign is fabricated from a substrate formed from a synthetic vinyl material. The substrate has top and bottom edges along with first and second opposed side edges. The substrate further has first and second generally parallel and planar surfaces extending across and between the edges of the substrate. A multicolor advertisement is printed in a predetermined pattern across all or substantially the entirety of at least one of the planar surfaces with solvent inks thereby yielding protection to the substrate against exposure to atmospheric elements thereby prolonging the usefulness of the sign during use. The substrate defines an opening having a closed margin and arranged in predetermined relation relative to the pattern on the substrate. The opening is spaced a predetermined distance from said at least two edges of the printed substrate such that when the imprinted substrate is arranged about the security system the opening in the substrate aligns with the detection apparatus so as to allow a signal generated by the detection apparatus of the security system to pass through the substrate. The two opposed side edges of said substrate are operably secured to each other so as to form an elongated sleeve-like advertisement with a pair of axially aligned open ends. The advertisement sleeve is sized such that, after the sign is fitted about and along said security system, a distance between the top and bottom edges of the substrate is less than a distance between the top and bottom portions of the security system with opposed planar surfaces of the sign being maintained in a tensioned condition, and with the opening facilitating proper alignment of the multicolor advertisement on the sign relative to the upstanding security system such that the imprinted substrate arranged about the security system defines an upstanding point-of purchase advertising medium.

In a preferred embodiment, the substrate for the sign has a thickness of about 12 mils. Moreover, the sign furthermore preferably includes a sticker adhesively secured to a predetermined area on the printed surface of the sign for effecting changes in the sign. In a most preferred form, a line of stitching operably secures the opposed side edges of the substrate to each other to provide the elongated sleeve-like shape to the sign. In one form, and to enhance the versatility of the advertising sign, a multicolor advertisement is printed across all or substantially the entirety of the other of the planar surfaces on the substrate preferably with solvent inks.

According to still another aspect, there is provided a method of making an advertising sign adapted to be arranged for use with an upstanding security system having a detection apparatus. The method includes the steps of: providing a sized substrate formed from a synthetic material and having top and bottom edges along with a pair of generally parallel and opposed side edges, with the substrate also having two generally planar surfaces extending between the top, bottom, and side edges; providing an opening, having a closed margin, in the substrate such that the opening extends between and opens to the two planar surfaces of the substrate, with the opening being spaced a predetermined distance from one of the top and bottom edges and at least one of the side edges such that, with the bottom edge of an imprinted substrate being arranged adjacent to a surface used to support the security system, alignment is affected between the opening in the substrate and the detection apparatus of the security system; printing advertising copy in a predetermined pattern across all or substantially an entire surface area defined by one of the planar surfaces on the substrate using multicolored solvent ink, with the solvent ink providing a coating over the substrate whereby protecting the sign against atmospheric elements which could damage the sign securing the opposed side edges of the substrate to each other so as to form an elongated sleeve like advertisement having a pair of axially aligned open ends, with the sides of the substrate being secured so as to size the sleeve-like advertisement to snugly fit over and along the upstanding security system, and with the opening facilitating proper alignment of the multicolor advertising copy on the sign relative to the security system such that the imprinted substrate, arranged about and along the security system, allows the security system to also serve as a point-of-purchase advertising media.

A preferred method includes the further step of: printing different advertising copy across all or substantially an entire surface area defined by the other of the planar surfaces on the substrate whereby enhancing the versatility of the advertising sign. Preferably, the method of making the advertising sign includes the further step of: providing an area on the printed copy for receiving a self-adhering sticker to allow for changes in the advertisement provided on the sign.

A primary feature of the present invention relates to converting existing space utilized by security systems at the entrance to a store or the like into a point of entry advertising system.

Another feature of the present invention relates to providing a relatively simple advertisement sign which can be inexpensively manufactured and utilized in an area optimizing exposure of the products/services being advertised from either side of the sign.

Another feature of the present invention relates to providing a relatively simple advertisement sign which optimizes the exposure of the advertised products/services and which can be updated and modified for promotional periods of time at an inexpensive cost.

Still another feature of the invention is to offer a simple and effective elongated apparatus for displaying advertising copy on opposite sides thereof and which is resistant to wind and adverse atmospheric conditions being directed thereagainst it.

These and other objects, features, aims and advantages of the invention will become more readily apparent by reading the following description of the preferred embodiment in conjunction with the accompanying drawings and appended claims.

BRIEF DESCRIPTION OF THE DRAWINGS

The file of this patent or patent application contains at least one photograph in color. Copies of this patent or patent application with color drawing(s) will be provided by the Patent and Trademark Office upon request and payment of the necessary fee.

FIG. 3 is a perspective view of a substrate forming part of the present invention;

FIG. 4 is an enlarged sectional view taken along line 4-4 of FIG. 3;

FIG. 5 is an enlarged sectional view taken along line 5-5 of FIG. 3;

FIG. 6 is a side elevational view of one form of an advertising embodying principals of the present invention;

FIG. 7 is a perspective view of one form of an advertising sign embodying principals of the present invention arranged separate from one form of security system;

FIG. 8 is a schematic flow chart illustrating a process for forming an advertising sign according to the present invention;

DETAILED DESCRIPTION OF THE INVENTION

Figure 1:
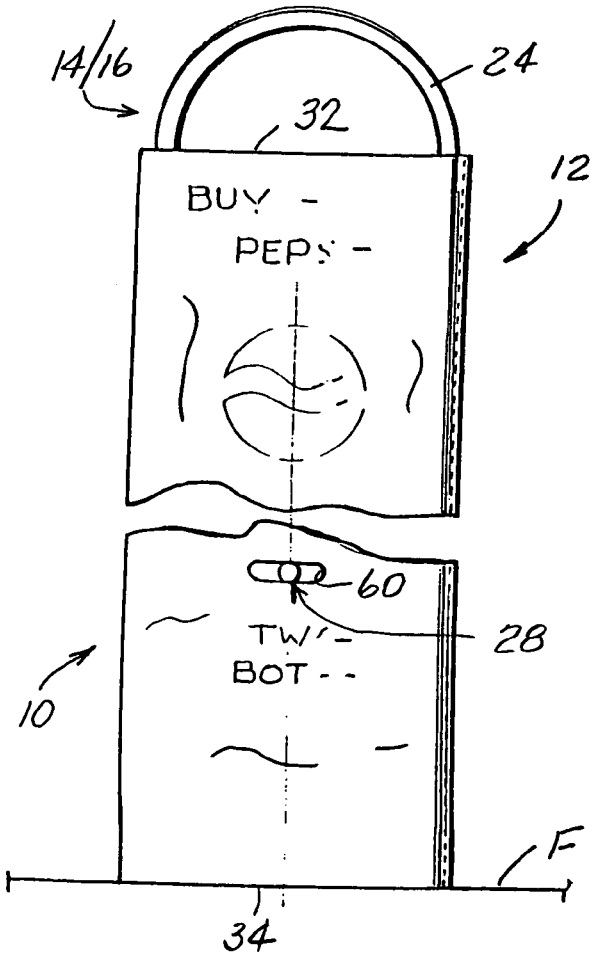
FIG. 1 is side elevational view of one form of an adverting sign, embodying principals of the present invention, shown in operable combination with one form of security system.

While the present invention is susceptible of embodiment in multiple forms, there is shown in the drawings and will hereinafter be described a preferred embodiment of the invention, with the understanding the present disclosure sets forth an exemplification of the invention which is not intended to limit the invention to the specific embodiment illustrated and described.

Figure 2:
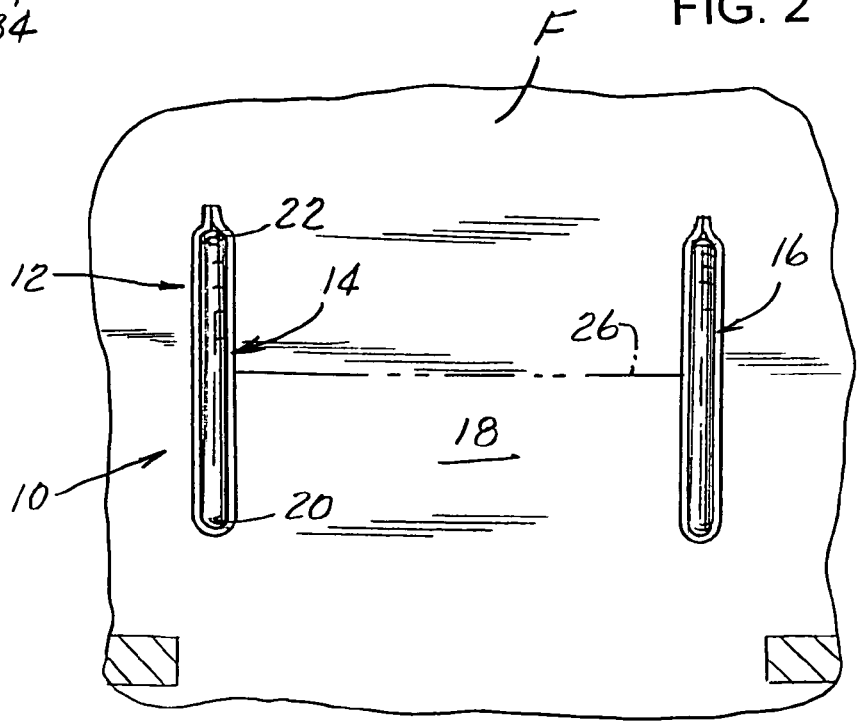
FIG. 2 is a top plan view of the advertising sign shown in FIG. 1 in operable combination with one form of security system.

Referring now to the drawings, wherein like reference numerals indicate like parts throughout the several views, FIG. 1 shows an advertising sign according to the present invention and generally indicated by reference numeral 10. As shown, advertising sign 10 is arranged in operable combination along and about a known security system, generally indicated by reference numeral 12. Suffice it to say, the security system 12 can be of the type manufactured by Checkpoint Systems located in Thorofare, N.J., and sold under Model Numbers QS2000 or QS 4000. As shown in FIG. 2, such a known security system 12 typically comprises two self-supporting and upstanding units 14 and 16 arranged in proximity to the entry/egress location 18, i.e. door or the like, to a store.

The upstanding and self-supporting units 14, 16 comprising security system 12 are substantially similar relative to each other and, thus, only unit 14 will be described in detail. As shown, each security unit 14, 16 is of a conventional self-supported or self-standing design that is configured to sit or stand on a floor F and which is designed of sufficiently dense material to provide stability to the unit 14. As shown in FIG. 2, unit 14 also defines a pair of opposed and generally parallel sides 20 and 22 which are laterally spaced apart a predetermined distance. The parallel sides 20, 22 of unit 14 extend upwardly from the floor F and are joined to each other at a top or upper end 24 (FIG. 1) of the unit 14.

The units 14, 16 of the conventional security system 12 are specifically designed such that an electronic signal, i.e. an infrared light beam, schematically illustrated in FIG. 2 and identified by reference numeral 26, is directed therebetween. In the embodiment illustrated in FIG. 1, one of the units 14, 16 is designed with an apparatus 28 for delivering the electronic signal, while the other unit in the system 12 is configured and designed to receive and record such signal. It should be appreciated that the security system shown is for exemplary purposes and the advertising sign 10 of the present invention equally applies to security systems having other designs without detracting or departing for the spirit and scope of the invention.

Turning to FIG. 3, the advertising sign 10 of the present invention is formed from a flexible and bendable substrate 30. In a preferred embodiment, the substrate 30 is fabricated from a synthetic material selected from the class of materials including: plastic and vinyl. Preferably, substrate 30 has a thickness ranging between about 10 mils. and about 14 mils. In a most preferred form, substrate 30 has a thickness of about 12 mils.

As shown in FIG. 3, substrate 30 has four edges including generally parallel top and bottom edges 32 and 34, respectively, and a pair of opposed and generally parallel side edges 36 and 38. The edges 32, 34, 36 and 38 of the substrate 30 are arranged relative to each other to provide the substrate 30 with a generally rectangularly shaped outer edge configuration. Furthermore, substrate 30 defines a first or outer major planar surface 42 on one side thereof and a second or inner major planar surface 44 on an opposite side thereof.

Figure 9:
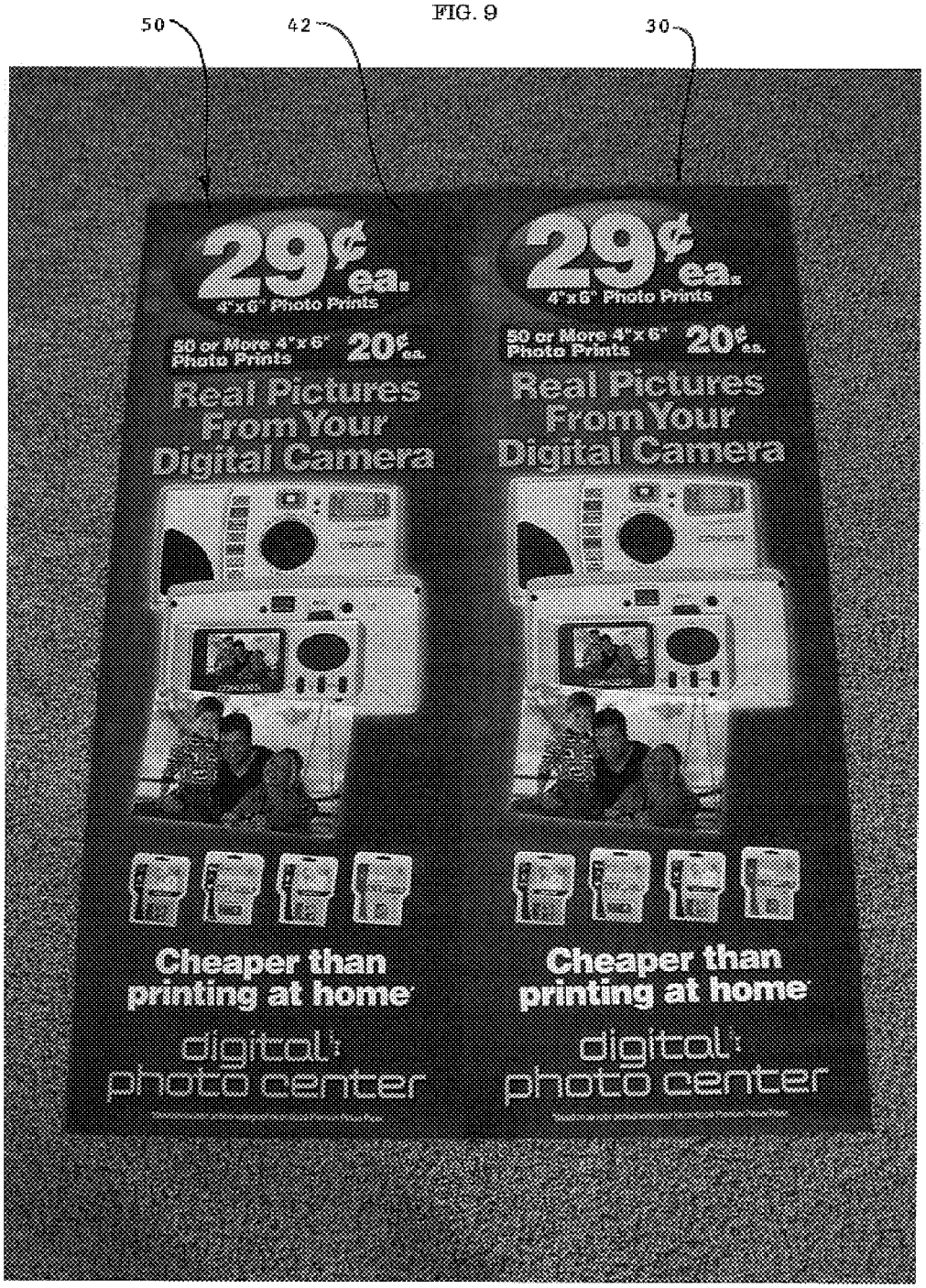
FIG. 9 is a color photograph depicting a multicolored advertising copy printed across all or substantially all of one surface of the substrate.
Figure 10:
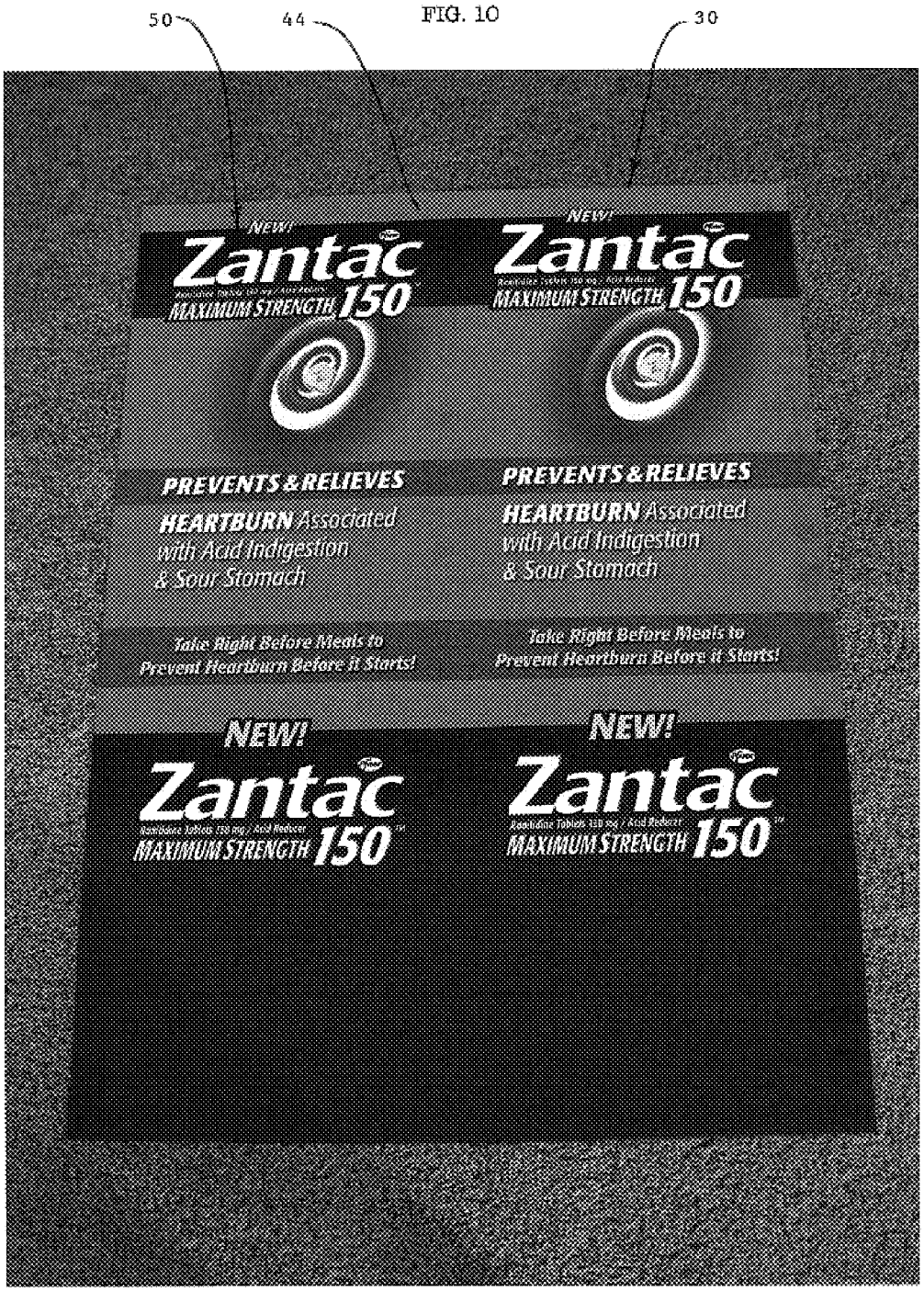
FIG. 10 is a color photograph similar to that shown in FIG. 9 but depicting another multicolored advertising copy printed across all or substantially all of another surface of the substrate.
Figure 11:
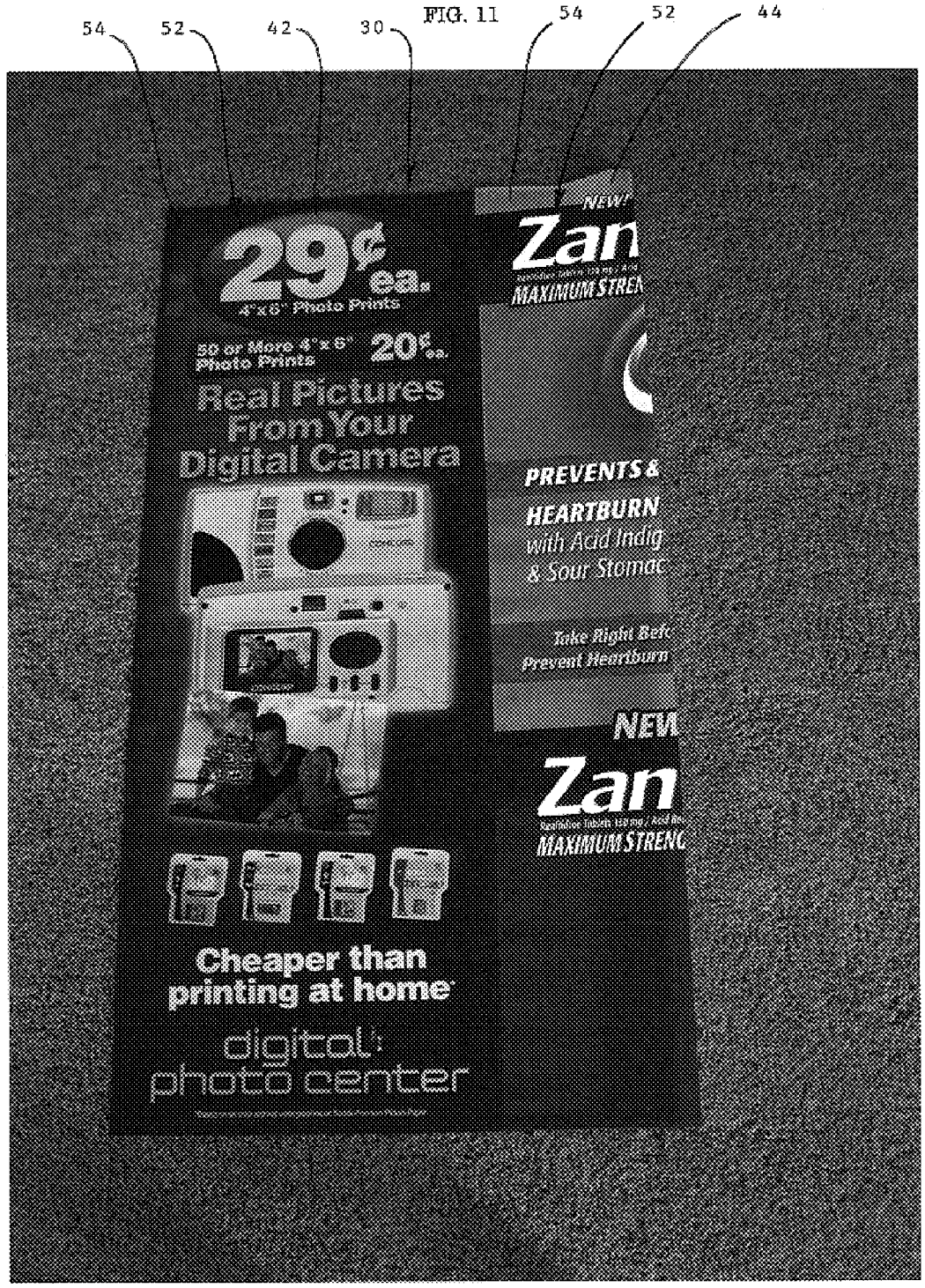
FIG. 11 is a color photograph similar to FIG. 9 but depicting a side edge of an imprinted substrate turned to show multicolored advertising copy is preferably imprinted on both surfaces of the substrate.

As shown in FIGS. 9 and 10, multicolored advertising copy 50, having a predetermined pattern 54 and which can include advertising indicia 52 (FIG. 3), is preferably printed across all or substantially the entirety of each major surface 42 and 44 of substrate 30. The indicia 52 printed on the substrate 30 can take varied forms, pictures, logos and the like. In a preferred form, and as depicted in FIG. 11, the predetermined pattern 54 and advertising indicia 52 printed on surface 42 of substrate 30 is preferably different from the predetermined pattern 54 and advertising indicia 52 printed on surface 44 of substrate 30 whereby enhancing the versatility of the substrate 30. Preferably, the predetermined pattern 54 is printed on each planar surface of the 42, 44 of the substrate using multicolor, UV cured, solvent inks 53 (FIG. 4) thereby yielding protection to the substrate 30 against exposure to atmospheric elements, i.e. rain, sleet, snow, ice, sun and etc., so as to prolong the usefulness of the sign 10 made from the substrate 30. Moreover, the indicia 52 and patterns 54 printed on the substrate 30 are specifically orientated and arranged to provide a desired effect when the sign 10 is arranged in combination with the security system 12.

As shown in FIG. 3, substrate 30 is provided with a hole or aperture 60 having a closed margin 62 and which opens to both surfaces 40 and 42 of the substrate 30. Notably, the closed margin 62 of the hole or aperture 60 is spaced a predetermined distance A from the edge 34 and a predetermined distance B from the edge 38 of the imprinted substrate 30.

In the embodiment illustrated in FIGS. 3 and 5, a sticker 70 can be secured to a predetermined area 72 on either printed planar face 40, 42 of the substrate for effecting changes, i.e. price, regarding the sign 10. Such sticker 70 preferably has a self-sticking adhesive 74 (FIG. 5) on one side thereof to allow the sticker 70 to be quickly and readily replaced with a like sticker thereby changing the advertisement without having to change the entire sign 10.

Referring now to FIGS. 3 and 6, the printed substrate 30 is folded lengthwise along fold line 76 until the edges 36 and 38 are superimposed relative to each other. The edges 36, 38 of the substrate 30 are thereafter operably secured to each other through use of any suitable means including gluing, sonic welding, or sewing. In the most preferred form, the edges 36, 38 are operably secured together by a line of stitching 78.

After the edges 36, 38 are operably secured to each other, and as shown in FIG. 7, the substrate 30 is configured to form the elongated sleeve-like advertising sign 10 having a pair of axially aligned open ends 80 and 82. Notably, in the preferred embodiment, the substrate 30 is sized such that after the edges 36, 38 are operably secured to each other, to form the sleeve-like structure, the elongated tube-like sign 10 is configured to fit along and about the respective unit of the security system 12 (FIG. 2) with the major printed surface 42 of the sign 10 being maintained in a slightly tensioned condition, without exceeding the maximum stretch without yield of the sleeve, to enhance display of the product/services advertised on the sign 10. Moreover, the substrate forming sign 10 is preferably sized such that, after the elongated tube-like sign 10 is fitted along and about the respective unit of the security system 12 (FIG. 2) with the bottom edge 34 of the imprinted substrate 30 being arranged adjacent to the floor F, the distance between the top and bottom edges 32 and 34, respectively, of sign 10 is somewhat less than the distance between the bottom and top ends 18 and 24, respectively, of the security system unit about and along which the sign 10 extends.

With the present invention, the existing space utilized by the aesthetically wanting security system 12 is easily and readily converted into a point of entry advertising system whereby optimizing exposure of the products/services displayed on sign 10 not only to select persons in the store but instead to each and every person going into and from the store. As such, not only are select persons exposed to the sign while wandering in the store but each and every person entering and leaving the store is provided with a store level reminder regarding the advertised products/services. Moreover, since the sign 10 adapted for use with the security system 12 is formed from a synthetic material concerns over exposure of the sign to atmospheric elements having an adverse impact thereon are eliminated. Additionally, the material from which substrate 30 is fabricated allows the lower edge 34 to be flush or in contact with the floor F without concerns over moisture being absorbed or "wicked" by the sign 10. Advantageously, and after the sign 10 is arranged in operable combination with the security system 12, the weight of the security system 12 inhibits the sign 10 from moving under the influence of winds while the size and mere presence of the security system inhibits people from bumping or otherwise inadvertently moving the sign as they move through the entrance to the store.

Not only does the sign of the present invention convert existing space utilized by the security system into an aesthetically pleasing point of entry advertising system, the sign 10 is furthermore designed as to not interfere with the on-going security measures provided by system 12. That is, the opening 60 in the sign 10 allows the security system 12 to operate in its normal mode of operation without requiring any special adjustments or modifications thereto. Moreover, aligning the opening 60 in the sign 10 with the detection apparatus 24 on the security system 12 ensures the printed indicia 52 and predetermined pattern 54 on sign 10 are properly orientated to provide maximum affect to the customers moving past the sign 10. Although sign 10 is preferably manufactured from a relatively inexpensive synthetic material, and is therefore expendable, the sticker 70 attachable to the sign 10 allows sign 10 to be changed to address a particular store need or desire without having to replace the entire sign 10. In either case, the sign 10 of the present invention provides an exceptionally simple and exceptionally inexpensive means of maximizing otherwise used floor space for prominently displaying certain advertised goods or services.

FIG. 8 schematically depicts those steps involved in a method for forming an advertising sign adapted for use with an upstanding security system. At step 84 of the process, a substrate 30 is provided. The substrate is preferably sized to fit the particular security system 12 with which sign 10 is to be arranged in operable combination and is formed from a synthetic material and has top and bottom edges along with a pair of opposed and generally parallel side edges, with said substrate also having two generally planar surfaces extending between the top, bottom and side edges. At step 86, an opening is provided in the substrate. The opening in the substrate has a closed margin and extends between while opening to the two planar surfaces of the substrate. The closed margin of the opening is spaced a predetermined distance from one of the top/bottom and opposed sides of the substrate. At step 88, advertising copy is printed in a predetermined pattern across substantially an entire major surface area defined by one of the planar surfaces on the substrate using multicolored solvent inks. The multicolored solvent inks used to print the indicia and advertising copy of the substrate provide a coating the substrate whereby protecting the sign against atmospheric elements which could damage the sign. At step 90, opposed sides of the substrate are secured in superposed relation relative to each other form an elongate sleeve-like advertisement having a pair of axially aligned open ends. The sides of the substrate are secured to each other to size the sleeve-like advertisement to snugly fit over and along the upstanding security system. The closed margin of the opening facilitates proper alignment and orientation of the advertising copy on the sign relative to the upstanding security system.

A preferred method further adds, at step 92, the step of printing different advertising copy across substantially an entire surface area defined by the other of the two major planar surfaces on the substrate whereby enhancing the versatility of the adverting sign. As will be appreciated, steps 88 and 92 could be effected concomitantly relative to each other without detracting or departing from the spirit and scope of the present invention. At step 94, a preferred method further adds the step of providing an area on the printed substrate for receiving a self adhesive sticker or label to allow changes or additions to be made to the sign 10.

From the foregoing, it will be observed that numerous modifications and variations can be made and effected without departing or detracting from the true spirit and novel concept of the present invention. Moreover, it will be appreciated, the present disclosure is intended to set forth an exemplification of the invention which is not intended to limit the invention to the specific embodiment illustrated. Rather, this disclosure is intended to cover by the appended claims all such modifications and variations as fall within the spirit and scope of the claims.

What is claimed:

1. In combination with a free standing security system having first and second sides and which is adapted to be arranged adjacent an ingress/egress opening to a store, said security system further including a detection apparatus, an advertising sign comprising:

a flexible one-piece substrate having a top edge, a bottom edge, and two generally parallel side edges arranged relative to each other to provide said substrate with a generally rectangularly shaped outer edge configuration, with said substrate further having first and second generally parallel and planar surfaces, and with a multicolor advertising copy being printed across all or substantially the entirety of at least one of said planar surfaces with solvent inks thereby yielding protection to said substrate against exposure to atmospheric elements so as to prolong the usefulness of the sign during use, with two opposed edges of said substrate being operably secured to each other so as to form an elongated and replacable sleeve-like advertisement with a pair of axially aligned open ends and which is configured to extend over and cover more than 60% of the length of each side of said free standing security system, with said sleeve being sized to fit along and about the length of said free standing security system such that the advertising copy on said sleeve-like advertisement, after being arranged about said security systems, permits said security system to present an upstanding point-of-purchase advertising medium on both sides of said security system whereby yielding a minimum of two visual advertising impressions to every person passing the security system.

2. The advertising sign according to claim 1, wherein said substrate has a thickness between said planar surfaces measuring about 10 mils to about 14 mils.

3. The advertising sign according to claim 1, further including a sticker adhesively secured to a predetermined area on the imprinted surface of said sign for effecting changes in advertising provided on said sign.

4. The advertising sign according to claim 1, wherein the side edges of said substrate are operably secured to each other by a line of stitching.

5. The advertising sign according to claim 1, further including a multicolor advertisement being imprinted across all or substantially the entirety of the other of said planar surfaces on said substrate with solvent inks thereby enhancing the versatility of the sign.

6. The advertising sign according to claim 1, wherein said substrate is formed from a synthetic material.

7. The advertising sign according to claim 1, wherein said substrate is made from plastic.

8. The advertising sign according to claim 1, wherein said substrate is made from vinyl.

9. The advertising sign according to claim 1, wherein said substrate defines an opening having a closed margin extending thereabout, with the closed margin of said substrate being spaced a predetermined distance from one of at least said bottom edge and said top edge and at least one of said side edges of said imprinted substrate such that, when said printed substrate is fitted about and along said security system alignment is affected between said opening and said detection apparatus of said security system whereby allowing passage of a signal from said detection apparatus of said security system to pass through said substrate.

10. The advertising sign according to claim 1, wherein said substrate defines an opening having a closed margin extending thereabout, with the closed margin of said substrate being spaced a predetermined distance from one of at least said top edge and said bottom edge and from at least one of said two side edges of said imprinted substrate such that, when said imprinted substrate is arranged about and along said security system, the closed margin of said opening facilitates alignment between said opening and said detection apparatus of said security system whereby allowing a signal from said detection apparatus of said security system to pass unobstructed and through said substrate.

11. In combination with a free standing security system having first and second sides and which is adapted to be arranged in proximity to an ingress/egress opening to a store, with said free standing security system further including a detection apparatus arranged between top and bottom edges of said security system, an advertising sign having a one-piece flexible substrate having top and bottom edges and first and second opposed side edges, with said substrate further having first and second generally parallel and planar surfaces extending across and between the edges of said substrate, and with a multicolor advertisement being imprinted in a predetermined pattern across all or substantially the entirety of one of said planar surfaces with solvent inks thereby yielding protection to said substrate against exposure to atmospheric elements thereby prolonging the usefulness of the sign during use, and with the two opposed side edges of said substrate being operably secured to each other so as to form an elongated and replacable sleeve-like advertisement, with said sleeve-like advertisement being sized such that, after being fitted about and along said security system, a distance between the top and bottom edges of said substrate is less than a distance between the top and bottom edges of said free standing security system but with more than 60% of both sides of said free standing security system being covered by said replacable sleeve such that the multicolored advertisement on both sides of said sign allows said security system to also serve as a point-of-purchase advertising media viewable from either side of said free standing security system whereby guaranteeing at least two visual impressions are presented to every person passing the security system.

12. The advertising sign according to claim 11, wherein said substrate has a thickness of about 12 mils.

13. The advertising sign according to claim 11, further including a sticker adhesively secured to a predetermined area on the imprinted surface of said sign for effecting changes in the advertisement provided on said sign.

14. The advertising sign according to claim 11, wherein a line of stitching operably secures the opposed side edges of said substrate to provide said elongated sleeve-like shape to said sign.

15. The advertising sign according to claim 11, further including a multicolor advertisement being imprinted across all or substantially the entirety of the other of said planar surfaces on said substrate with solvent inks thereby enhancing the versatility of the sign.

16. The advertising sign according to claim 11, wherein said substrate is made from plastic.

17. The advertising sign according to claim 11, wherein said substrate is made from vinyl.

18. A method of forming an advertising sign adapted to be arranged for use with for use with a security system extending upwardly from a floor, with said security system having a detection apparatus arranged in operable combination therewith, said method comprising the steps of:

providing a sized substrate formed from a synthetic material and having a top and bottom edges along with a pair of generally parallel and opposed side edges, said substrate also having two generally planar surfaces extending between said top, bottom and said side edges;

providing an opening having a closed margin in said substrate such that said opening extends between and opens to the two planar surfaces of said substrate, with the closed margin of said opening being spaced a predetermined distance from one of said top and bottom edges and at least one of said side edges such that, with the bottom edge of an imprinted substrate being arranged adjacent to the floor, alignment is affected between said opening in said substrate and said detection apparatus of said security system;

printing advertising copy across all or substantially an entire surface area defined by one of said planar surfaces on said substrate using multicolored solvent ink, with said solvent ink providing a coating over said substrate whereby protecting said sign against atmospheric elements which could damage said sign;

securing the opposed side edges of said substrate to each other so as to form an elongated sleeve like advertisement having a pair of axially aligned open ends, with said sides of said substrate being secured so as to size the sleeve-like advertisement to snugly fit over and along the upstanding security system, with the closed margin of said opening facilitating proper alignment of the multicolor advertise copy on said sign relative to the upstanding security system such that said imprinted substrate arranged about said security system allows said security system to also serve as a point-of-purchase advertising media.

19. The method of forming a sign according to claim 18 including the further step of: printing different advertising copy across substantially an entire surface area defined by the other of said planar surfaces on said substrate whereby enhancing the versatility of said advertising sign.

20. The method of forming a sign according to claim 18 including the further step of: providing an area on said printed advertising copy for receiving a self-adhering sticker to allow for changes in the advertisement provided by said sign.

21. In combination with a free standing security system having first and second sides and which is adapted to be arranged in proximity to an ingress/egress opening to a store, an advertising sign including a replacable one-piece sleeve structure having top and bottom edges, first and second opposed side edges, along with opposed surfaces extending across and between the edges of said sleeve structure, and with a multicolor advertisement being imprinted in a predetermined pattern across all or substantially the entirety of each opposed surface of said sleeve structure, and with said replacable sleeve structure being sized such that, after being fitted about and along said security system, a distance between the top and bottom edges of said sleeve structure is less than a distance between the top and bottom edges of said free standing security system but with more than 60% of both sides of said free standing security system being covered by said replacable sleeve structure such that the multicolored advertisement on both sides of said sleeve structure allows said security system to also serve as a point-of-purchase advertising medium viewable from either side of said free standing security system whereby guaranteeing at least two visual advertising impressions are presented by said advertising sign to every person passing the security system.

22. The advertising sign according to claim 21, further including a sticker adhesively secured to a predetermined area on the imprinted surface of said sleeve structure for effecting changes in the advertisement provided on said sign.

23. The advertising sign according to claim 21, wherein said sleeve structure is made from vinyl.

24. The advertising sign according to claim 21, wherein said sleeve is made from plastic.

25. The advertising sign according to claim 21, wherein sleeve is made from vinyl.

26. The advertising sign according to claim 21, wherein said sleeve defines an opening having a closed margin extending thereabout, with the closed margin of said opening defined by said sleeve being spaced a predetermined distance from one of at least said bottom edge and said top edge and at least one of said side edges of said sleeve such that, when said sleeve is fitted about and along said security system alignment is affected between said opening and a detection apparatus of said security system whereby allowing passage of a signal from said detection apparatus of said security system to pass through said sleeve.

27. The advertising sign according to claim 21, wherein the multicolor advertisement is printed across all or substantially the entirety of each opposed surface with solvent inks thereby yielding protection to said sign against exposure to atmospheric elements so as to prolong the usefulness of the sign during use.

* * * * *